United States Patent [19]

Hanthorn

[11] Patent Number: 4,793,437

[45] Date of Patent: Dec. 27, 1988

[54] PORTABLE LIFT WITH TELESCOPIC BOOMS AND LOAD-CARRYING APPARATUS

[76] Inventor: Philip Hanthorn, Box 276, San Francisco, Calif. 94101

[21] Appl. No.: 75,410

[22] Filed: Jul. 20, 1987

[51] Int. Cl.[4] ..... E06C 5/04

[52] U.S. Cl. ..... 182/102; 182/82; 182/2; 182/206; 187/10

[58] Field of Search ..... 182/2, 101, 102, 103, 182/63, 206, 82; 52/116, 117, 118; 187/9 E, 10

[56] References Cited

U.S. PATENT DOCUMENTS

| | | | |
|---|---|---|---|
| 2,297,572 | 1/1942 | Martin | 187/10 |
| 2,394,148 | 8/1944 | Campbell | 214/103 |
| 2,400,939 | 11/1944 | Martin | 214/100 |
| 2,858,154 | 7/1953 | Johansson | 287/53 |
| 2,936,849 | 5/1960 | Larson | 182/204 |
| 3,190,393 | 10/1963 | Alfano | 182/194 |
| 3,420,393 | 6/1967 | Atchison | 182/211 |
| 3,512,658 | 8/1968 | Harlan | 214/1 |
| 3,563,364 | 2/1969 | Arndt | 198/120.5 |
| 3,653,463 | 4/1972 | Neal | 182/195 |
| 3,666,054 | 5/1972 | Ellings | 187/10 |
| 3,804,275 | 4/1974 | Lee | 214/152 |
| 3,858,684 | 1/1975 | Goings | 182/207 |
| 3,871,481 | 3/1975 | Ballek | 182/151 |
| 3,891,062 | 6/1975 | Geneste | 187/10 |
| 4,289,215 | 9/1981 | Robinson | 182/92 |
| 4,406,097 | 9/1983 | Meston | 52/118 |
| 4,411,330 | 10/1983 | Blokland | 180/8 A |
| 4,491,196 | 1/1985 | Bocker | 187/10 |
| 4,546,854 | 10/1985 | Bocker | 182/103 |
| 4,550,806 | 11/1985 | Bocker | 187/10 |
| 4,550,807 | 11/1985 | Ohlgren | 187/10 |

*Primary Examiner*—Reinaldo P. Machado

*Attorney, Agent, or Firm*—Phillips, Moore, Lempio & Finley

[57] ABSTRACT

Inclined telescopic booms actuated and regulated from the ground with detachable rungs forming a level track between the telescopic booms. A two-stacked load carrier, both stages on crawler type endless tracks, wherein the lower stage of the load carrier spans multiple rungs and is supported by the rungs, and is operable independent of the rungs. The chassis on the lower load carrier is comprised of two sections which are adjustable horizontally. The upper stage of the load carrier upon which cargo is hauled operates so that it can move independently on the ground, ride peggyback on the lower stage and then move independently through a window or similar opening on into the interior of a building. The load carrier and the telescopic booms are raised and lowered by a cable which is guided and supported by an overhead clamp which can be attached to the window frame of a building, to a construction platform, or to a shelf such as in a wharehouse.

44 Claims, 7 Drawing Sheets

PORTABLE LIFT WITH TELESCOPIC BOOMS AND LOAD-CARRYING APPARATUS

BACKGROUND—FIELD OF INVENTION

This invention relates to a portable conveyor, especially to one with inclined telescopic booms on which a load-carrying apparatus can be moved.

BACKGROUND—DESCRIPTION OF PRIOR ART

Heretofore, many types and variations of inclined conveyors have been designed. Regarding the telescopic booms or members used on such conveyors, one general type utilizes gears, chains, pullies, cables and similar mechanisms usually fixed permanently to the interior of the members. Although control of the members, extension and contraction, is very precise, this design can be costly to manufacture, has a maintenance factor, and the members tend to be very heavy, which in turn requires a subtantial base, making such conveyors large and therefore difficult to operate close to a building and in limited space; moreover, the overall size and weight of this conveyor tends to place it in the category of being movable rather than portable.

Regarding telescopic members, another type utilizes springs and levers usually fixed permanently either to the interior or exterior of the members. Although generally light in weight and portable, this design suffers from the limitation of not having a capability for precision adjustment. Hence, to bring the top of the members exactly level with the window frame of a building, for example, the base of the members is moved closer to or farther away from the building, a method of adjustment that is not always practical. Also, within this general design, the members rest directly against a building for their support while in use, and then while being reeved up and down the members maintain contact with the building which can cause damage to the structure in that siding, roofing materials and window frames can be quite delicate.

Telescopic members by their very nature create a staircase effect when in the extended position, which then imposes an obstacle when such members are used for rails on which a load-carrying apparatus is to pass. As shown in the art, the approaches set forth to overcome this obstacle are many. One approach is to attach additional connecting rails where the members join so that the wheels or rollers of a load-carrying apparatus can pass from one member to the next. And similar approaches show that switch blocks, bridges, and conjunction mechanisms are utilized.

Another approach is to design the chassis of the load-carrying apparatus with suspension and heavy-duty wheels that will merely assist the carrier as it passes from member to member. So that these approaches form a category in which the telescopic members remain uneven, and the load-carrying apparatus must pass over this unevenness, which is not entirely satisfactory.

Forming yet another category to overcome the staircase effect is to make specially designed members that have internal guides, channels, lips and the like so that one of the four surfaces of such a member is flat, and as a result a load-carrying apparatus can move over this flat surface very effectively. However, there is an additional manufacturing cost with specially designed members, and such members tend to be heavy and bulky which reduces their portability.

Removable crossbars employed to support telescopic members and employed as rungs such as those found on a climbing ladder are well known in the art. The removable crossbars have the advantage of making the telescopic members very portable for the reason that the entire unit can be disassembled. The art also shows removable crossbars that are attached to the telescopic members by means of screws, nuts, bolts, clamps and various combinations thereof, all of which have habitually been a disadvantage for the reason that such crossbars are time consuming to assemble onto the telescopic members and relatively costly to manufacture.

Load-carrying apparatus used on inclined members are also well known in the art. The most basic type is a load-carrying platform on wheels or rollers. Not being adjustable to where the platform can be brought to the horizontal position, this type is particularly ineffective when it comes to moving any cargo thereon through an upper opening and into the interior of a structure.

Another load-carrying apparatus, also on wheels or rollers, is of the type that has an adjustable platform, and when the platform is horizontal at the upper end the transfer of cargo into and out of a structure is improved.

Another load-carrying apparatus is of the type that has an additional wheel or roller means on a secondary track so that the platform of the carrier when horizontal allows cargo to be transferred directly from the platform to the secondary track and on into the interior of a structure. But a laborer must still transfer that cargo from the secondary track to yet a different location.

Another load-carrying apparatus is of the type that utilizes, for example, a primary and secondary platform, adjustable horizontally, and a primary and secondary track, wherein the cargo, being on the secondary platform, can be brought into the interior of a structure on the secondary track, and, depending on the length of the secondary track, the labor time to move the cargo within the structure is reduced. This arrangement, however, is still encumbered by some deficiencies in that the secondary platform on the carrier is not detachable from the secondary track, and consequently labor time is expended when cargo is transferred from the end of the secondary track to a different location. A deficiency of a more serious nature is to be found upon considering the platform on the primary carrier when this carrier is at its lowest position on the primary track, being the position at which cargo is advantageously loaded and unloaded. If the primary carrier is not detachable from the primary track, a very prevalent configuration observed in the art, the platform on the carrier when horizontal, being generally necessary for the loading of cargo, will be well above ground level, a circumstance that makes the loading and unloading process very cumbersome. This circumstance, moreover, will be exacerbated whenever the telescopic members or booms of the conveyor are brought closer to the building, owing to the fact that the platform will need to be raised higher in order to keep it horizontal. And the net effect is that this conveyor as a unit has reduced capability with respect to operating it in tight spaces.

OBJECTS AND ADVANTAGES

Accordingly, the present invention provides the following objects and advantages: Having telescopic booms with no mechanisms permanently affixed, which will reduce the manufacturing cost and will reduce the weight of the booms for increased portability. Having telescopic booms whose extension and retraction can be precisely controlled, which is advantageous in that the floors of buildings, the window sills, construction activities, wharehouse shelves as well as other applications can all vary in height. Having a relatively short base to support the telescopic booms, which then allows the conveyor as a unit to be operated close to a building and in relatively tight spaces generally. Having a reeving means with an overhead structure to support the telescopic booms while being reeved and when extended, which will keep the booms from making direct contact with the building and thus avoid causing damage to the building. Having detachable rungs that can be assembled onto the telescopic booms in multiples of two or more, which simplifies the assembly process and reduces to a minimum the time required to attach the rungs to the booms. Having rungs that, owing to their varying widths and depths, will overcome the staircase effect inherent in telescopic booms, which then provides a level surface for use as a conveyor track. Having a load-carrying apparatus comprised of two stages designed to operate independent of each other, and designed so that both stages operate independent of the telescopic booms, which provides easy loading and unloading of cargo at ground level and at an upper level, such as in the interior of a building. Having a conveyor that is highly portable in the sense that a multi-sectioned ladder is portable, one that can be assembled, operated, and disassembled by a single operator skilled in the art, and one that can be manufactured relatively inexpensively.

Further objects and advantages will become evident when considering the ensuing description and drawings.

DRAWING FIGURES

Figure 6A:
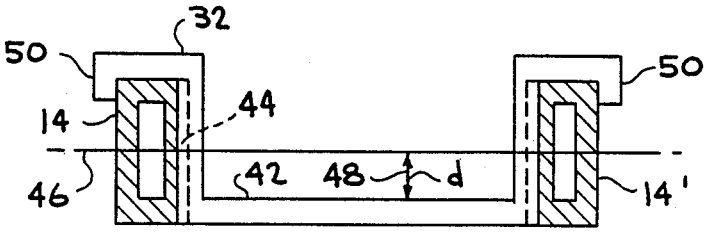

FIG. 6A is a cross section of booms 14, 14', and shows how rung 32 fits into rung slots 44.

Figure 6B:
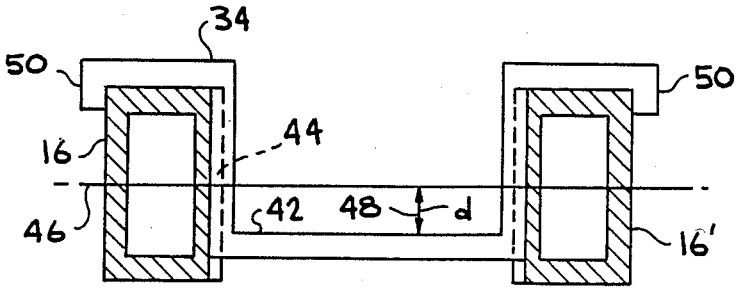

FIG. 6B is a cross section of booms 16, 16', and shows how rung 34 fits in rung slots 44.

Figure 6C:
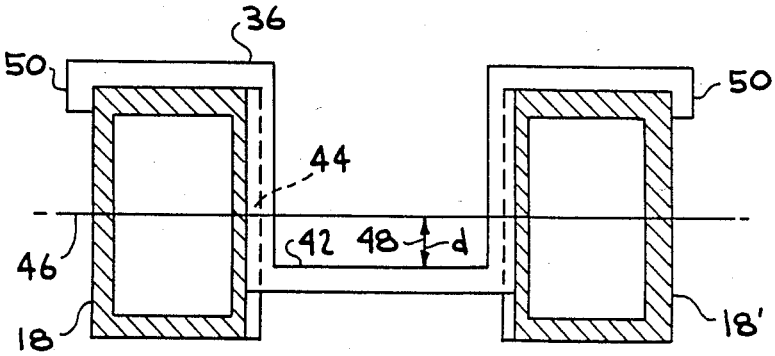

FIG. 6C is a cross section of booms 18, 18', and shows how rung 36 fits into rung slots 44.

FIGS. 6A, 6B, 6C also show how the plane through the center of the booms 46 maintains an equal distance to the rungs to create the plane of rungs 42.

Figure 2:
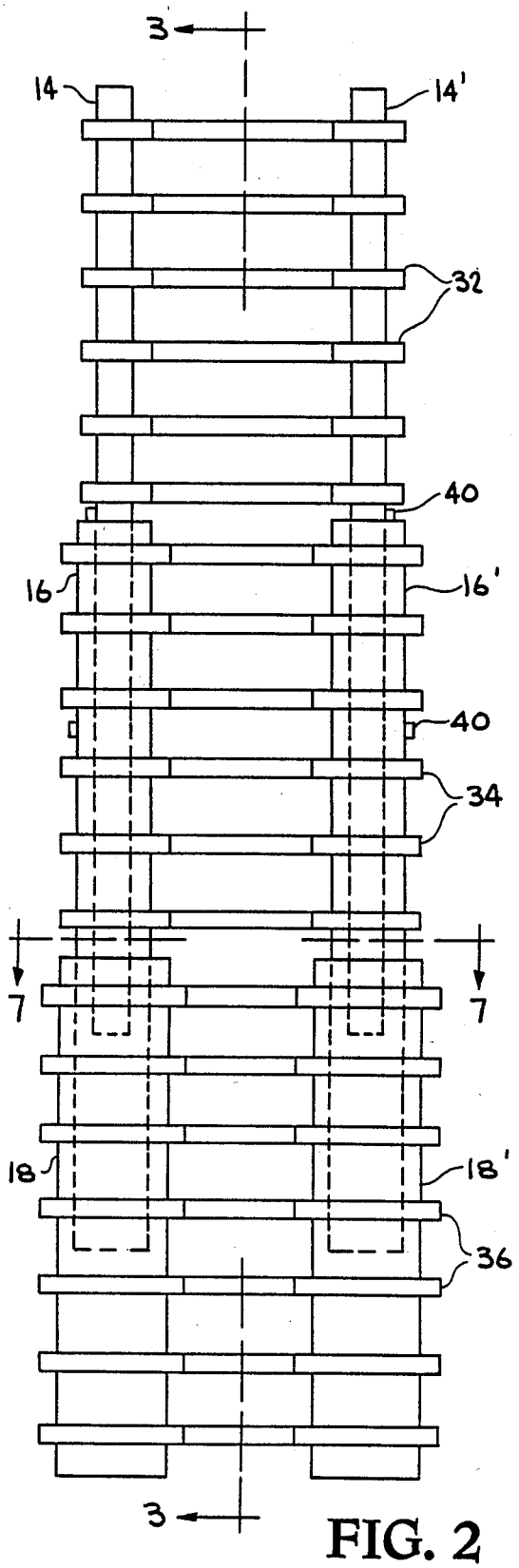
FIG. 2 shows booms with rungs attached.
Figure 7:
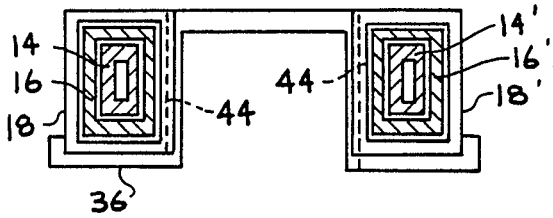

FIG. 7 is a cross section of FIG. 2 looking in the direction of arrows 7.

Figure 8:
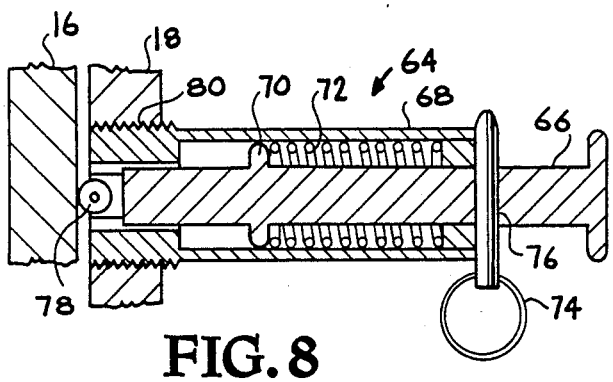

FIG. 8 shows a cross section of a locking mechanism.

Figure 9:
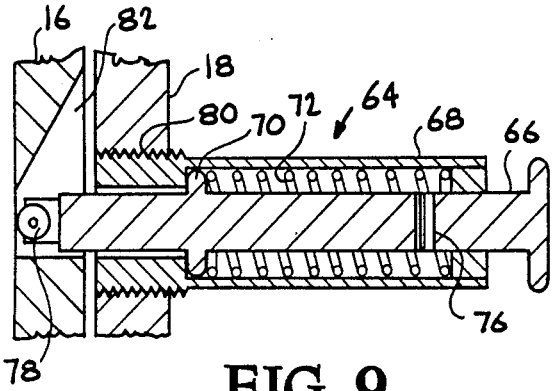

FIG. 9 shows a cross section of a locking mechanism with wheel 78 riding on ramp 86.

Figure 10:
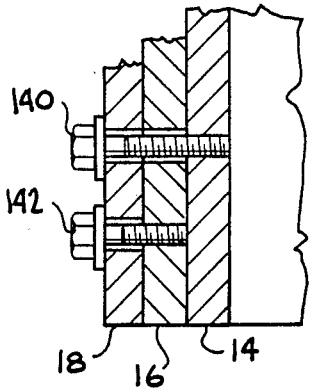

FIG. 10 shows the boom sequencing bolts.

Figure 11:
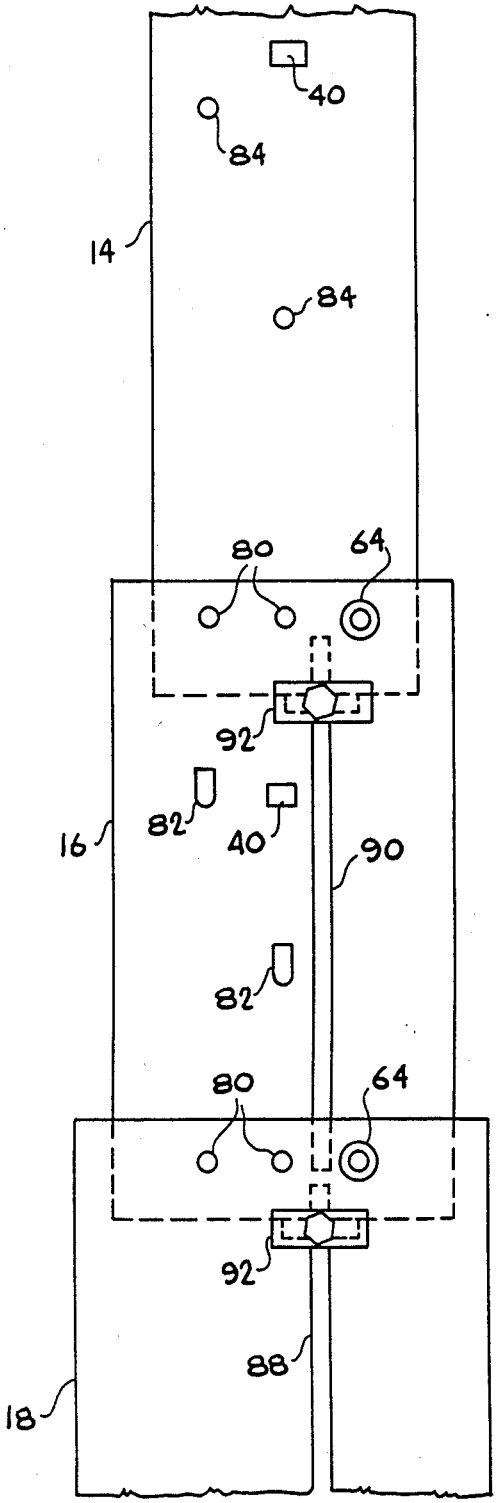

FIG. 11 shows the booms in the fully extended position.

Figure 12:
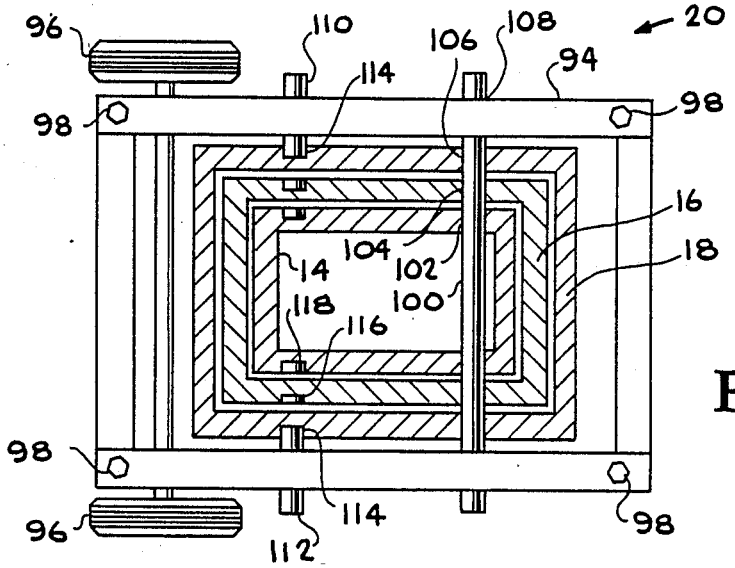

FIG. 12 shows a boom transporting cart 20 with support shaft 100 and pivoting shafts 110, 112.

Figure 13:
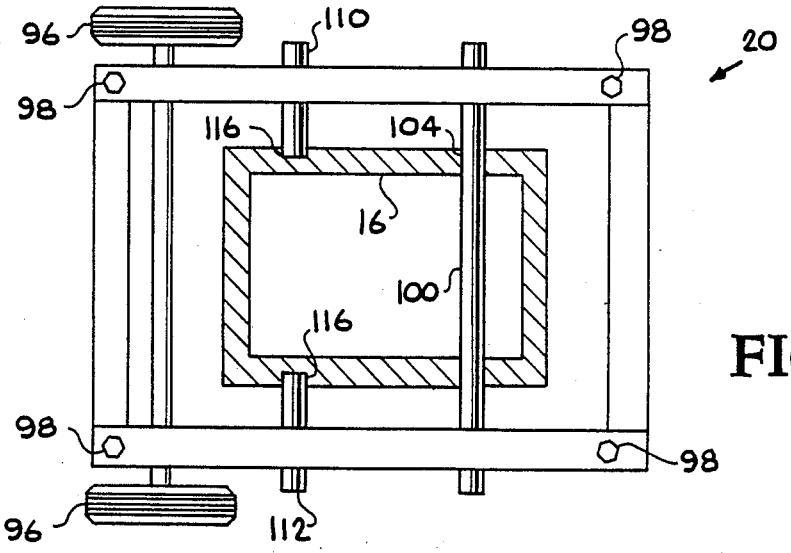

FIG. 13 shows how the transporting carts will support the booms individually.

Figure 14:
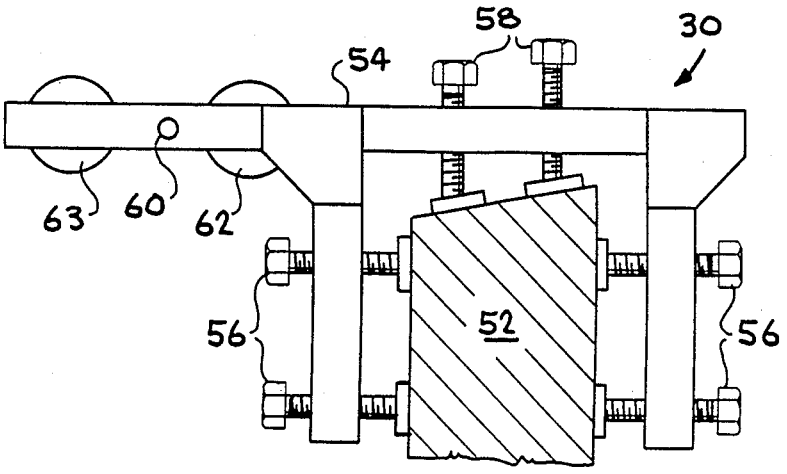

FIG. 14 shows a side view of the overhead mounting clamp 30.

Figure 15:
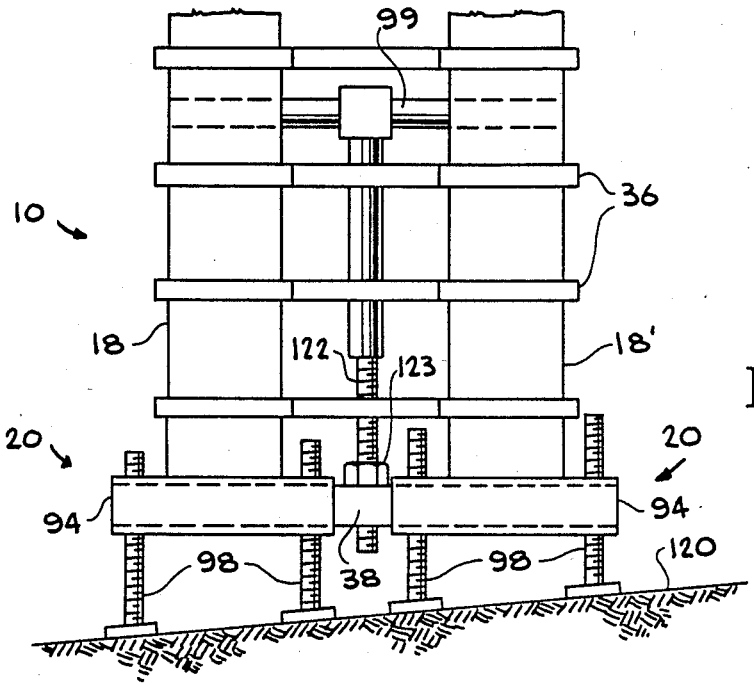

FIG. 15 shows the boom leveling jacks 98 and how the spacer bar 38 and the boom tilt adjustment means control the booms.

Figure 16:
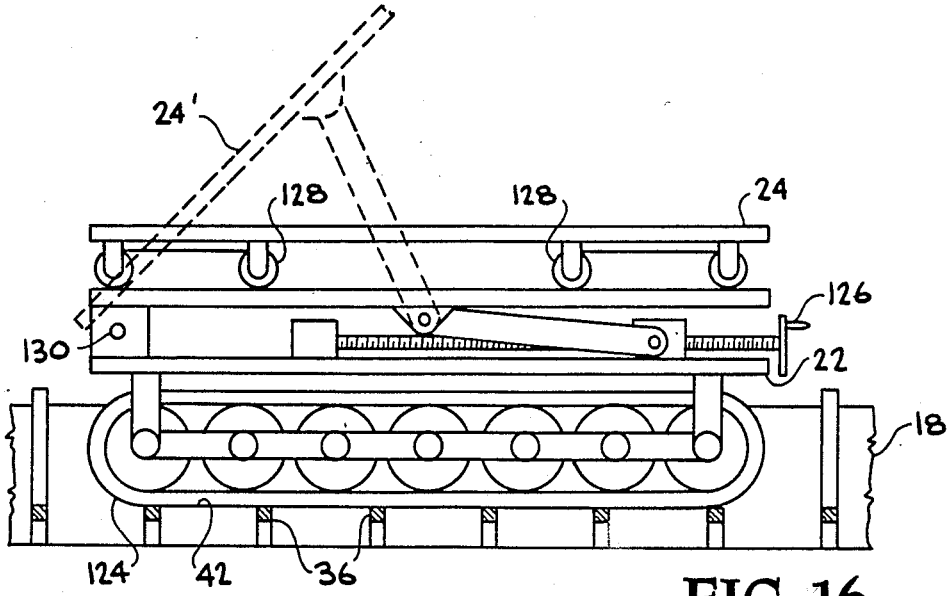

FIG. 16 shows load carriers 22, 24 and the positioning mechanism 126, and the endless track system.

Figure 17:
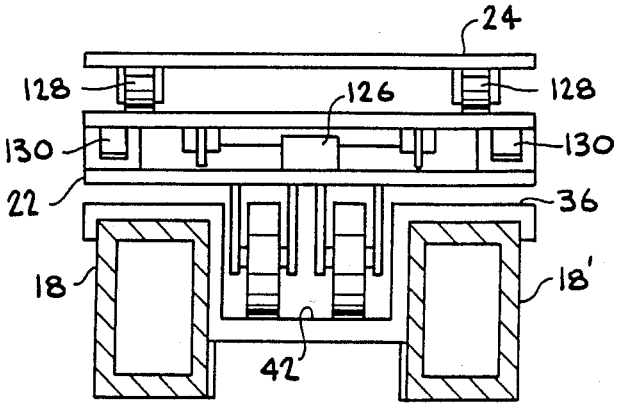

FIG. 17 shows the load-carrying apparatus from a rear view on booms 18, 18'.

Figure 18:
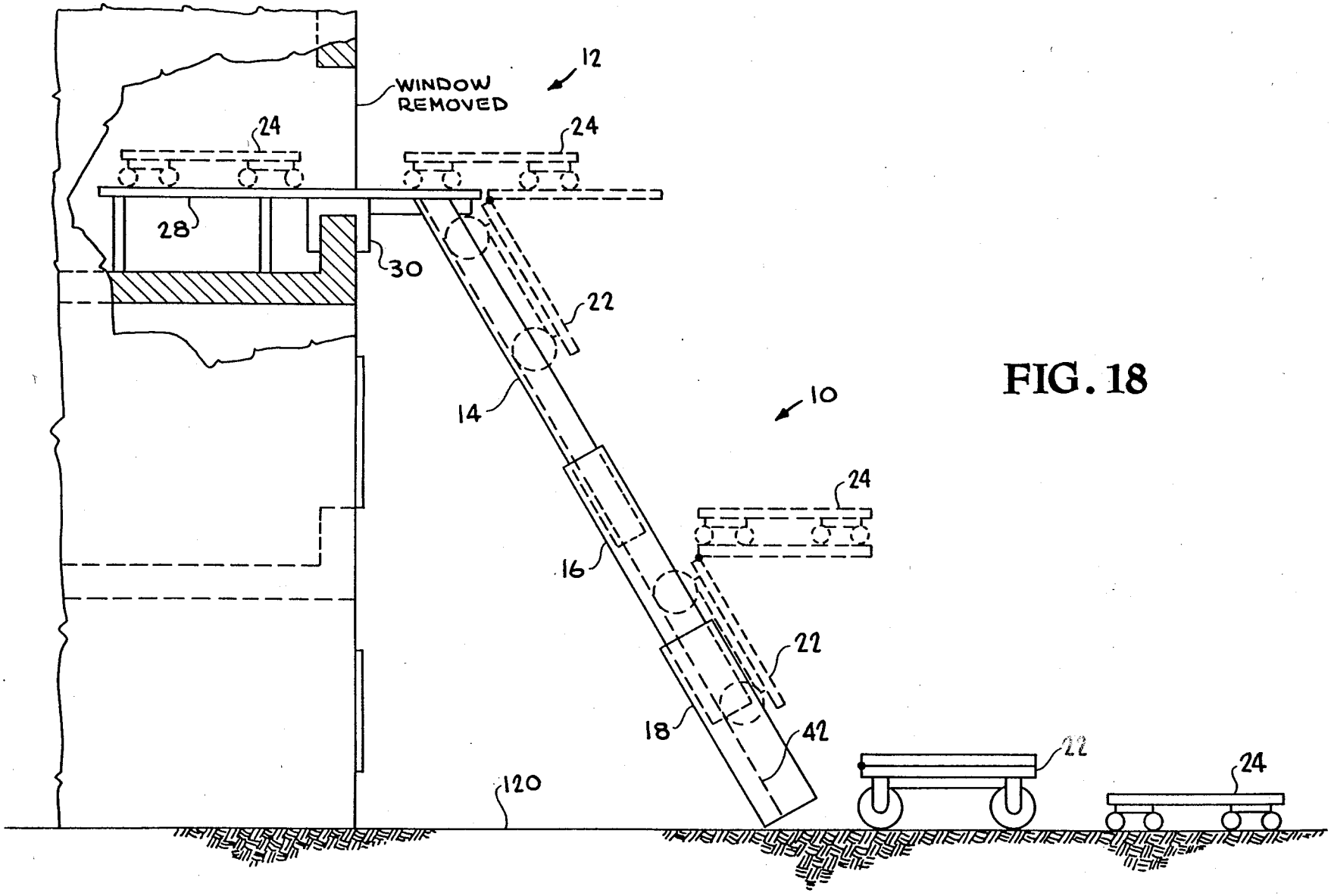

FIG. 18 shows how load carriers 22, 24 operate independently of the booms and how they operate independently of each other and as a single unit.

DESCRIPTION

As shown in FIG. 12, boom transporting cart 20 is rectangular shaped to receive and support a set of rectangular-shaped booms therein. Boom support shaft 100 is inserted through boom support shaft hole 108 of cart frame 94 and through boom support shaft holes 106, 104, 102 consecutively, supporting the rear of one set of booms off the ground. Boom pivoting shafts 110, 112 are inserted through cart frame 94 and into successive boom pivoting holes 114 of boom 18, supporting the front of this set of booms off the ground. Cart frame wheels 96 are located at the front of boom transporting cart 20.

As shown in FIG. 15, spacer bar 38 attaches to the front of boom transporting carts 20, t-member 99 attaches to the upper level of booms 18, 18'; boom tilt adjustment means 122 with boom tilt adjustment nut 123 attaches to spacer bar 38, and to the t-member. And frame leveling jacks 98 are fixed to the boom transporting carts 20.

As shown in FIG. 11, booms 14, 16, 18 are in the fully extended position. Locking mechanisms 64 (seen in detail FIG. 8) are attached to locking mechanism mounting holes 80 on booms 16 and 18. Boom up-locks 92 (seen in detail FIGS. 4 and 5) are inserted and secured in locking slots 88 and 90 of booms 16 and 18. Locking mechanism 64 attached to the right most locking mechanism mounting hole 80 on boom 16 stops boom 14 in the fully extended position by aligning with the right most locking mechanism receiving hole 84 on boom 14. Locking mechanism 64 attached to the right most locking mechanism mounting hole 80 on boom 18 stops boom 16 in the fully extended position by aligning with the right most locking mechanism receiving hole 82 on boom 16. Boom up-lock 92 (seen in detail FIGS. 4 and 5) in locking slot 88 of boom 18 securely locks boom 16 in the fully extended position. Boom up-lock 92 in locking slot 90 of boom 16 securely locks boom 14 in the fully extended position.

Figure 1:
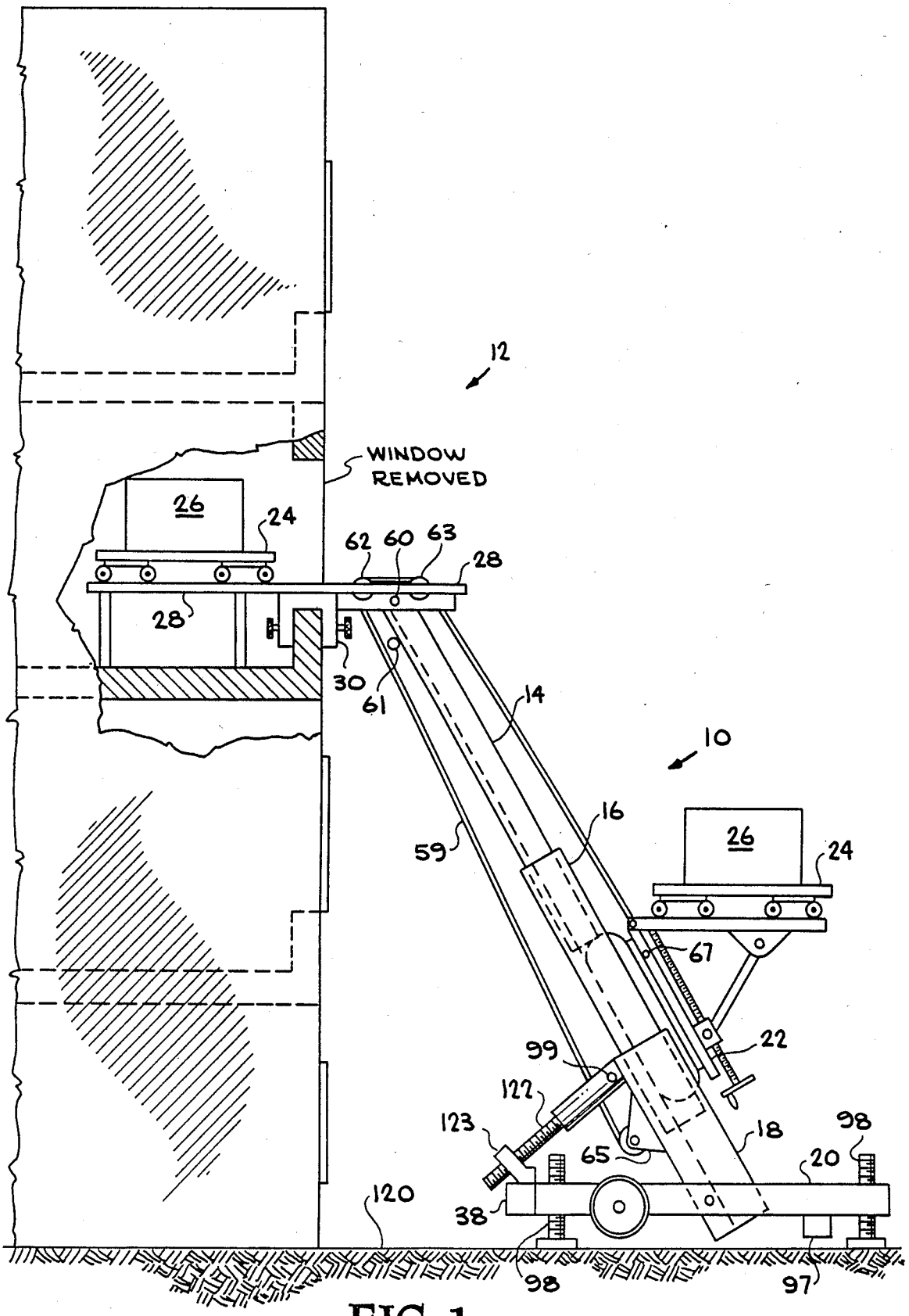
FIG. 1 shows an overall view of the conveyor system 10.

As shown in FIG. 1, boom 14 is fastened to the overhead mounting clamp 30 at boom fastening point 60 (seen in detail FIG. 14).

Figure 3:
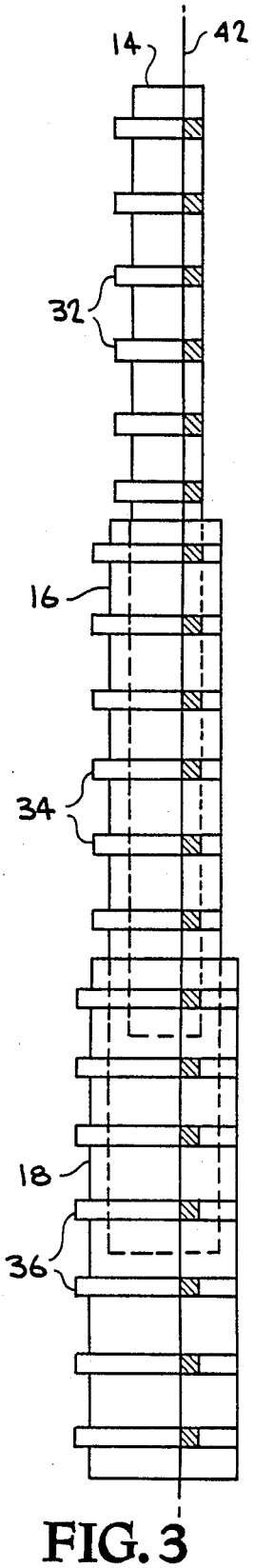
FIG. 3 is a cross section of FIG. 2 and shows plane of rungs 42.

As shown in FIG. 6C, detachable rung 36 is attached to booms 18, 18' by fitting into rung slots 44 in said booms. The projecting edges 50 of detachable rung 36 encircle said booms. Detachable rung 34 as shown in FIG. 6B is attached to booms 16, 16' by fitting into rung slots 44 in said booms. Projecting edges 50 of detachable rung 34 encircle said booms. Detachable rung 32 as shown in FIG. 6A is attached to booms 14, 14' by fitting into rung slots 44 in said booms. Projecting edges 50 encircle said booms. Plane through center of booms 46 and plane of rungs 42 maintain an equal distance 48, which can be observed in FIGS. 6C, 6B, 6A. Plane of rungs 42 provides a non-stepped surface between booms 18, 16, 14 when detachable rungs 36, 34, 32 are attached to said booms, which is shown more clearly in FIG. 3.

As shown in FIG. 16, the primary load carrier 22 is supported on an endless track system 124, which in turn is supported on detachable rungs 36 attached to boom 18. The secondary load carrier 24 riding piggyback on primary carrier 22 is also supported on an endless track system 128. The primary load carrier 22 has position mechanism 126, capable of angling the secondary carrier 24 in alternate positions, shown in phantom 24'.

IN OPERATION

The entire conveyor would be transported on a small vehicle such as a pickup truck or on a trailer. The two sets of booms would be in the fully retracted position and would preferably be transported on an overhead rack of said vehicle or trailer. Boom sequencing bolts 140, 142 FIG. 10 would be installed during transport, a safety measure to ensure that the booms won't telescope. On site, an operator would preferably undertake the following procedures.

Place the boom transporting carts 20 below the booms and set the booms into said carts, in that the booms will be standing upright on the ground inside said carts. Insert boom support shafts 100 and boom pivoting shafts 110,112, with the result of having the two sets of booms supported in said carts and off the ground. The boom transport carts 20 on cart frame wheels 96 are then wheeled into general location. The rear of said carts as seen in FIG. 1 are on legs 97 which prevent said carts holding said booms from rolling once positioned. As shown in FIG. 13, boom pivoting shafts 110, 112 will support boom 16 independently in boom transporting cart 20, and said pivoting shafts will also support booms 14 and 18 independently in said carts. Said booms can also be used in said carts in varying combinations, which provides greater utility for the conveyor overall.

Referring to FIGS. 1 and 15, spacer bar 38 is attached to the front of the transporting carts 20. The spacer bar ensures that said carts are at a fixed distance apart, are parallel, and that the carts are even, in that one is not ahead of or behind the other. The t-member 99 is then attached to booms 18, 18'. The boom tilt adjustment means 122 is then attached to the t-member and to the spacer bar. Boom support shafts 100 are now removed from the boom transporting carts 20. Stop plates 40 as seen in FIGS. 2 and 11 prevent booms 14, 14' and 16, 16' from collapsing downward. When the boom tilt adjustment means 122 is adjusted contractingly by operating the boom tilt adjustment nut 123, the two sets of booms pivot forward in unison on pivoting shafts 110, 112.

The overhead mounting clamp 30 is taken to the upper level. FIG. 1 shows the mounting clamp 30 in perspective. FIG. 14 shows it in detail. With the window of structure 12 removed said clamp is fitted onto sill 52. The top leveling means 58 are adjusted to ensure that frame structure 54 of mounting clamp 30 is horizontal. The adjustable side clamping means 56 are then adjusted inward, securing said clamp to said sill. The top leveling means 58 and the adjustable side clamping means 56 where they make contact with the sill would preferably be well padded to avoid causing damage to structure 12. Reeving cable 59 FIG. 1 is looped over boom erecting pulley 62 on the overhead mounting clamp 30. One end of said cable is attached to cable fastening means 61 on boom 14, FIG. 1. The other end of said cable is attached to the winch 65.

Utilizing the reeving cable 59 as a guide, the two sets of booms are aligned with frame structure 54 of the overhead mounting clamp 30. Cart frame leveling jacks 98 seen in FIGS. 12 and 15 are then adjusted to where the boom transporting carts 20 are slightly above ground level 120, which is best observed in FIG. 1. With said carts off the ground, the booms are held in a fixed location. The cart frame leveling jacks 98 are then adjusted to ensure that the boom transporting carts 20 which are holding said booms are level which is best observed in FIG. 15.

Locking mechanisms 64, FIG. 8, are attached to the booms. Based on the desired height to which the booms are to be extended, the locking mechanisms 64 are attached to locking mechanism mounting holes 80 on booms 18, 18' and 16, 16'. Stop plates 40 ensure that the locking mechanism mounting holes 80 don't become concealed inside the next outer boom. Referring to FIG. 11, it can be seen that boom 18 has three locking mechanism mounting holes 80. Boom 16 the hext inner most boom has three locking mechanism receiving holes 82 which are at varying levels along the face of boom 16. At the top of boom 16, there are three more locking mechanism mounting holes 80. Boom 14 the next most inner boom has three locking mechanism receiving holes 84 which are at varying levels along the face of boom 14. The left most mounting hole 80 on boom 18 is directly aligned with the left most receiving hole 82 on boom 16. The left most mounting hole 80 on boom 16 is directly aligned with the left most receiving hole 84 on boom 14. AS shown in FIG. 11, locking mechanisms 64 are attached to the right most mounting holes 80 on booms 18 and 16. The locking mechanisms 64 are aligned with the right most receiving holes 82 and 84 on booms 16 and 14 respectively, which, as shown in FIG. 11, puts the booms in the fully extended position. A detail of a locking mechanism 64 is shown in FIG. 8. Here, the locking mechanism is threadedly attached to boom 18. Shaft 66 with retainer 70 fixed to it is movable within housing 68. Spring 72 fits behind retainer 70 and when spring lock pin 74 is removed, shaft 66, now biased outwardly by spring 72, penetrates mounting hole 80 and comes in contact with boom 16. Wheel 78 on shaft 66 reduces friction as boom 16 is extended and retracted. After locking mechanisms 64 are attached to the desired locking mechanism mounting holes 80, the spring lock pins 74 are removed. The boom sequencing bolts 140, 142 are shown in FIG. 10, and said bolts ensure that the booms are extended in order, the inner most boom 14 first the next most inner boom 16 second. When boom sequencing bolt 140 is removed, boom 14 is free to extend, whereas boom 16 is still locked down by boom sequencing bolt 142, which in turn is removed after boom 14 is extended to the desired height.

The winch 65 is then operated so that the reeving cable 59 is retracted onto said winch. As said cable is retracted, boom 14 is extended. When shaft 66 penetrates receving hole 84 on boom 14, booms 14 and 16 will be locked together and both booms will be extended in unison. When shaft 66 penetrates receiving hole 82 on boom 16, boom 16 will be prevented from over extending and becoming separated from boom 18, but booms 16 and 18 will not be locked together.

Booms 14, 14' are fastened to the overhead mounting clamp 30 at boom fastening point 60 as shown in FIG. 1, a perspective view, and in FIG. 14, a detailed view of boom fastening point 60. If the booms are not in vertical alignment with fastening point 60, a precise adjustment can be obtained by operating the boom tilt adjustment means 122 as shown in FIGS. 1 and 15. If the booms are not in horizontal alignment with fastening point 60, a precise adjustment can be obtained by operating said winch. As shown in FIG. 9, locking mechanism receiving hole 82 on boom 16 is beveled so that wheel 78 on shft 66 can ride on ramp 86 of receiving hole 82 on boom 16. When boom 16 is extended, said wheel on said shaft can ride down said ramp of said receiving hole. When boom 16 is retracted, said wheel on said shaft can ride up said ramp on said receiving hole, so that the extension and retraction of the booms can be controlled with total precision. When booms 14, 14' are aligned with boom fastening point 60, the booms are secured to the overhead mounting clamp 30.

Figure 4:
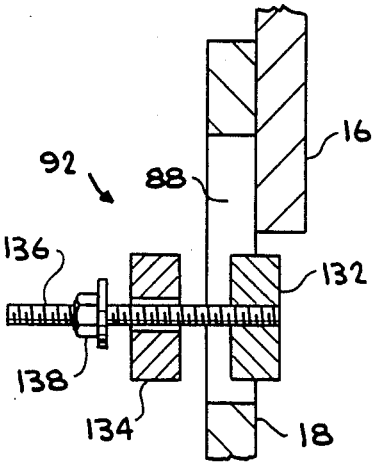
FIG. 4 shows the boom up-lock system 92.
Figure 5:
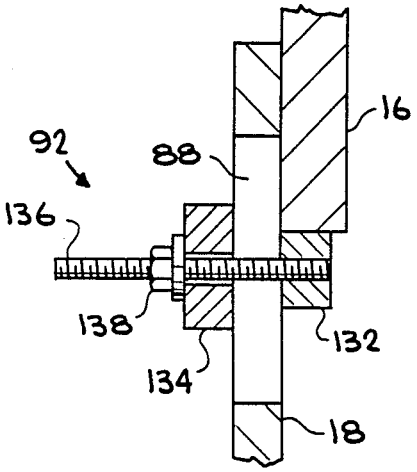
FIG. 5 shows a second view of the boom up-lock system 92.

As shown in FIGS. 4 and 5, the boom up-lock means 92 will solidly lock the booms at a fixed position. In FIG. 4, locking bar 132 on stud 136 is being inserted vertically through slot 88 on boom 18. In FIG. 5, the locking bar 132 now in the horizontal position and up against the bottom edge of boom 16 is, in conjunction with clamping bar 134, tightened firmly against boom 18 by adjusting nut 138 inward. FIG. 11 provides an additional view of how boom up-lock means 92 is inserted through locking slot 88 on boom 18 and how locking slot 88 is elongated so that boom 16 can be precisely locked down at any height to which the booms are extended.

As shown in FIG. 2, detachable rungs 36 are then assembled onto booms 18, 18', a single rung assembled onto said booms is shown more clearly in FIG. 6C. It can also be observed in these Figures that the detachable rungs are rectangular shaped and that rung slots 44 in said booms are also rectangular shaped, so that the detachable rungs can be assembled onto the booms in multiples of two or more which greatly reduces the assembly time of said rungs onto said booms. Detachable rungs 34 are then assembled onto booms 16, 16', a single rung assembled onto said booms is shown more clearly in FIG. 6B. Detachable rungs 32 are then assembled onto booms 14, 14', a single rung assembled onto said booms is shown more clearly in FIG. 6A. The load receiving platform 28 seen in FIG. 1 is then fastened to the overhead mounting clamp 30 (fastening means not shown). The reeving cable 59 is then relocated so that it is looped over the load carrier lifting pulley 63.

As shown in FIG. 16, the secondary carrier 24 is supported and movable on endless track system 128, so that it can be operated independently of the primary load carrier 22, which is seen more clearly in FIG. 18. The secondary load carrier 24 being an independent vehicle can be taken to any location so that cargo 26 as shown in FIG. 1 can be loaded onto said carrier. The secondary load carrier 24 is then loaded piggyback onto the primary load carrier 22 as shown in FIG. 16. Referring to FIG. 15, it can be observed that spacer bar 38 is attached to the front of boom transporting carts 20, so that the rear of the transporting carts is open to receive the primary load carrier 22 therebetween. The primary load carrier 22 is supported and movable on endless track system 124, so that it is an independent vehicle, which is seen more clearly in FIG. 18. The primary load carrier 22 is then brought up to the base of booms 18, 18' at ground level 120. The reeving cable 59 is attached to the cable fastening means 67 FIG. 1 on primary carrier 22 and said carrier is then winched onto rungs 36 attached to booms 18, 18'. As shown in FIG. 16, the endless track 124 on primary carrier 22 spans multiple detachable rungs 36 which support the primary load carrier 22 and its load. As shown in FIG. 17, the primary carrier 22 is on booms 18, 18' and ready to be winched upward. Positioning mechanism 126 is then operated to move the secondary load carrier 24 into the horizontal position. In FIG. 16, it can be observed that hinge point 130 in conjunction with positioning mechanism 126 allows the secondary carrier 24 to be raised to the horizontal position which is also shown in phantom 24'. By referring to FIG. 1, it can be observed that the secondary carrier 24 is in the horizontal position and both carriers are being winched up the conveyor. The primary carrier 22 upon reaching the upper level aligns with the load receiving platform 28, so that secondary carrier 24 can be brought into the interior of structure 12. The secondary load carrier 24 being an independent vehicle will roll free of the load receiving platform 28, so that cargo 26 can be taken to any location within said structure. The progression of the load carriers on the ground, on the conveyor booms, on the load receiving platform and inside the structure can be seen more clearly in FIG. 18.

Even though the above description contains many specifics, these should not be construed as limitations on the scope of this invention, but rather as exemplifications of preferred embodiments, and therefore to those skilled in the art many variations could be envisioned. For example, the number of telescopic booms, their shape, size and length as well as the material of which they are made could be varied considerably. The detachable rungs, so long as they did not interfere with the telescopic action of the booms and could be assembled onto the booms in multiples of two or more, could have various dimensions and means of attachment to the booms. With repsect to the adjustment of the booms, the holes and slots could easily be reduced or increased in number and be assigned to alternate locations on the booms, and the locking means could easily be modified with mechanisms having a more automatic system and thus having fewer manual steps of operation. The load-carrying apparatus is unique in that the two stages of the carrier can be operated independently of one another and can be operated independently of the primary and secondary track system on the conveyor, but it should be readily apparent that the variations to achieve these features are many. Additionally, the reeving of the booms and raising and lowering of the load carrying apparatus could be accomplished with various sources of power such as battery packs, an electric or gas motor, and in fact the load carriers themselves could be operated with battery packs or other sources of power, so that the carriers would have their own power as opposed to being pushed or pulled by human power. And hydraulics, for example, would be very suitable for leveling the booms, controlling the angle of the booms and the angle of the load-carrying apparatus. Moreover, the booms and detachable rungs will function well as a ladder, and also as a conveyor system in a loading dock area in that the booms could extend from the dock into the back of truck trailer. The conveyor can also function in a temporary assembly-line setting. Accordingly, the scope of this invention should be determined by the appended claims and their equivalents.

I claim:

1. A portable conveyor comprising a pair of extensible and retractable telescopic booms positioned in side-by-side relationship, support means having lower ends of said booms mounted thereon, said booms being inclined to extend upwardly and forwardly from said support means, a plurality of longitudinally spaced rungs interconnected between said booms to define a series of supporting surfaces, and an independently mobile primary load carrier means mounted for movement on the supporting surfaces of said rungs, said primary load carrier means including a load-carrying primary platform and adjustment means for selectively moving said primary platform to a horizontally disposed position.

2. The portable conveyor of claim 1 wherein each of said booms comprises a plurality of telescopic boom sections and wherein said rungs are interconnected between laterally adjacent sections of said booms.

3. The portable conveyor of claim 2 wherein the support surfaces of said rungs are at least substantially disposed in the same imaginary flat plane.

4. The portable conveyor of claim 1 wherein said primary load carrier means further includes endless track means for engaging and moving along said surfaces.

5. The portable conveyor of claim 1 further comprising an independent and mobile secondary load carrier means mounted on the primary platform of said primary load carrier means, said secondary load carrier means including a horizontally disposed load-carrying secondary platform and endless track means having said secondary platform mounted thereon.

6. The portable conveyor of claim 2 wherein the lower ends of said booms are each pivotally mounted on said support means and further comprising boom tilt adjustment means for selectively and simultaneously pivoting said booms on said support means to selectively vary the inclination of said booms.

7. The portable conveyor of claim 1 further comprising means for selectively raising or lowering said primary load carrier means on the supporting surfaces of said rungs, and for selectively extending or retracting said booms.

8. The portable conveyor of claim 1 further comprising a horizontally disposed load receiving platform attached to upper ends of said booms and having an outer end positioned adjacent to said booms for horizontal alignment with said primary platform when said primary load carrier means is moved to the upper ends of said booms.

9. The portable conveyor of claim 1 further comprising attachment means for releasably attaching the upper ends of said booms to a fixed member.

10. The portable conveyor of claim 9 wherein said attachment means comprises a generally C-shaped mounting clamp positionable on said fixed member and means for releasably securing said mounting clamp to said fixed member.

11. The portable conveyor of claim 2 further comprising first locking means for releasably locking a telescoped pair of inner and outer boom sections of said boom sections together in on of a plurality of extended positions relative to each other.

12. The portable conveyor of claim 11 wherein said first locking means comprises at least two laterally spaced first holes formed through said outer boom section and at least two longitudinally and laterally spaced second holes formed in said inner boom section and longitudinally aligned with said first and second holes, respectively.

13. The portable conveyor of claim 12 wherein said first locking means further comprises a locking mechanism detachably mounted on an outer side of said outer boom section including a reciprocal shaft having an end thereof disposed in one of said first holes and spring means for biasing said shaft towards and into a respective second hole formed in said inner boom section.

14. The portable conveyor of claim 13 further comprising ramp adjustment means defined adjacent to each of said second holes for engaging a distal end of said reciprocal shaft to permit controlled extension and retraction of said inner boom section relative to said outer boom section.

15. The portable conveyor of claim 11 further comprising second locking means for releasably securing said inner and outer boom sections together.

16. The portable conveyor of claim 15 wherein said second locking means comprises a longitudinally extending slot formed through said outer boom section, a locking bar disposed on an inner side of said outer boom section, and means for securing said locking bar to said outer boom section at a selected longitudinal position along said slot to engage said locking bar with a lower end of said inner boom section.

17. The portable conveyor of claim 16 wherein said second locking means further comprises a threaded stud extending through said slot and having said locking bar attached to a distal end thereof, a clamping bar disposed on an outer side of said outer boom section and nut means threadably mounted on a proximal end of said stud and disposed on an outer side of said clamping bar for clamping said outer boom section between said locking bar and said clamping bar.

18. The portable conveyor of claim 16 wherein said locking bar has a width less than the width of said slot and a length greater than the width of said slot whereby said locking bar is adapted to be inserted through said slot, rotated 90 degrees and clamped to the inner side of said outer boom section.

19. A portable conveyor comprising boom means extendible to position an upper end thereof adjacent to a fixed load receiving area, mobile support means having lower ends of said boom means mounted thereon, said boom means being inclined to extend upwardly and forwardly from said support means, supporting surfaces defined at least substantially throughout the length of said boom means, an independently mobile primary load carrier means mounted for movement on said supporting surfaces, said primary load carrier means including a load-carrying primary platform and adjustment means for selectively moving said primary platform to a horizontally disposed position, and an independent and mobile secondary load carrier mounted on the primary platform of said primary load carrier means.

20. The portable conveyor of claim 19 wherein said boom means comprises a plurality of detachable telescopic boom sections and wherein said supporting surfaces are defined on longitudinally spaced rungs detachably connected to said boom means.

21. The portable conveyor of claim 20 wherein the support surfaces of said rungs are at least substantially disposed in the same imaginary flat plane.

22. The portable conveyor of claim 19 wherein said primary load carrier means further includes endless track means for engaging and moving along said support surfaces.

23. The portable conveyor of claim 19 wherein said secondary load carrier means includes a horizontally disposed load-carrying secondary platform and endless track means having said secondary platform mounted thereon.

24. The portable conveyor of claim 2 wherein said boom means comprises a pair of telescopic booms having their lower ends each pivotally mounted on said support means and further comprising boom tilt adjustment means for selectively and simultaneously pivoting said booms on said support means to selectively vary the inclination of said booms.

25. The portable conveyor of claim 19 further comprising means for selectively raising or lowering said primary load carrier means on said supporting surfaces.

26. The portable conveyor of claim 19 further comprising a horizontally disposed load receiving platform attached to the upper end of said boom means and having an outer end positioned adjacent to said boom means for horizontal alignment with said primary platform when said primary load carirer means is moved to the upper end of said boom means.

27. The portable conveyor of claim 19 further comprising attachment for releasably attaching the upper end of said boom means to a fixed member located at said fixed load receiving area.

28. The portable conveyor of claim 27 wherein said attachment means comprises a generally C-shaped clamp positionable on said fixed member and means for releasably securing said mounting clamp to said fixed member.

29. The portable conveyor of claim 20 further comprising first locking means for releasably locking a telescoped pair of inner and outer boom sections of said boom sections together in one of a plurality of extended positions relative to each other.

30. The portable conveyor of claim 29 wherein said first locking means comprises at least two laterally spaced first holes formed through said outer boom section and at least two longitudinally and laterally spaced second holes formed in said inner boom section and longitudinally aligned with said first and second holes, respectively.

31. The portable conveyor of claim 30 wherein said first locking means further comprises a locking mechanism detachably mounted on an outer side of said outer boom section including a reciprocal shaft having an end thereof disposed in one of said first holes and spring means for biasing said shaft towards and into a respective second hole formed in said inner boom section.

32. The portable conveyor of claim 31 further comprising ramp adjustment means defined adjacent to each of said second holes for engaging a distal end of said reciprocal shaft to permit controlled extension and retraction of said inner boom section relative to said outer boom section.

33. The portable conveyor of claim 29 further comprising second locking means for releasably securing said inner and outer boom sections together.

34. The portable conveyor of claim 33 wherein said second locking means comprises a longitudinally extending slot formed through said outer boom section, a locking bar disposed on an inner side of said outer boom section, and means for securing said locking bar to said outer boom section at a selected longitudinal position along said slot to engage said locking bar with a lower end of said inner boom section.

35. In a portable conveyor having at least one extensible and retractable telescopic boom, said boom including at least one telescoped pair of inner and outer boom sections, the invention comprising first locking means for releasably locking said telescoped pair of inner and outer boom sections together in one of a plurality of extended positions relative to each other, said first locking means comprising at least two laterally spaced first holes formed through said outer boom section and at least two longitudinally and laterally spaced second holes formed in said inner boom section and each longitudinally aligned with a respective one of said first holes, and a locking mechanism detachably mounted on an outer side of said outer boom section including a reciprocal shaft having an end thereof disposed in one of said first holes and spring means for biasing said shaft towards and into a respective second hole formed in said inner boom section.

36. The portable conveyor of claim 35 further comprising ramp adjustment means defined adjacent to each of said second holes for engaging a distal end of said reciprocal shaft to permit controlled extension and retraction of said inner boom section relative to said outer boom section.

37. The portable conveyor of claim 35 further comprising second locking means for releasably securing said inner and outer boom sections together.

38. The portable conveyor of claim 37 wherein said second locking means comprises a longitudinally extending slot formed through said outer boom section, a locking bar disposed on an inner side of said outer boom section, and means for securing said locking bar to said outer boom section at a selected longitudinal position along said slot to engage said locking bar with a lower end of said inner boom section.

39. The portable conveyor of claim 38 wherein said second locking means further comprises a threaded stud extending through said slot and having said locking bar attached to a distal end thereof, a clamping bar disposed on an outer side of said outer boom section and nut means threadably mounted on a proximal end of said stud and disposed on an outer side of said clamping bar for clamping said outer boom section between said locking bar and said clamping bar.

40. The portable conveyor of claim 38 wherein said locking bar has a width less than the width of said slot and a length greater than the width of said slot whereby said locking bar is adapted to be inserted through said slot, rotated 90 degrees and clamped to the inner side of said outer boom section.

41. The portable conveyor of claim 1 wherein said support means comprises a pair of laterally mobile transport carts each having one of said booms mounted thereon and spacer bar means attached between said carts to hold said carts and said booms in parallel relationships at preset distances from each other.

42. The portable conveyor of claim 41 further comprising leveling jack means attached to each of said carts for adjusting said carts to a horizontal disposition relative to ground level.

43. The portable conveyor of claim 1 wherein each of said booms comprises inner, intermediate and outer telescopic boom sections and further comprising first releasable locking means for selectively permitting only extension of said inner boom section relative to said intermediate and outer boom sections and second releasable locking means for selectively permitting extension of said intermediate boom section relative to said outer boom section.

44. The portable conveyor of claim 1 wherein each of said booms comprises at least one pair of telescopic boom sections and further comprising stop means secured on one of said boom sections for delimiting relative retraction of said boom sections.

* * * * *